US011454120B2

(12) United States Patent
Fredmonski et al.

(10) Patent No.: US 11,454,120 B2
(45) Date of Patent: Sep. 27, 2022

(54) TURBINE AIRFOIL PROFILE

(71) Applicant: General Electric Company, Schenectady, NY (US)

(72) Inventors: Adam Fredmonski, Simpsonville, SC (US); Moorthi Subramaniyan, Bangalore (IN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 455 days.

(21) Appl. No.: 16/212,950

(22) Filed: Dec. 7, 2018

(65) Prior Publication Data

US 2020/0182065 A1 Jun. 11, 2020

(51) Int. Cl.

| | |
|---|---|
| ***F01D 5/14*** | (2006.01) |
| ***F04D 29/38*** | (2006.01) |
| ***F04D 29/66*** | (2006.01) |

(52) U.S. Cl.

CPC ..... *F01D 5/145* (2013.01); *F04D 29/384* (2013.01); *F04D 29/667* (2013.01); *F05D 2240/242* (2013.01); *F05D 2240/301* (2013.01); *F05D 2240/307* (2013.01)

(58) Field of Classification Search

None

See application file for complete search history.

(56) References Cited

U.S. PATENT DOCUMENTS

| | | | | |
|---|---|---|---|---|
| 2,714,499 | A * | 8/1955 | Warner | F01D 5/16 416/243 |
| 5,282,721 | A | 2/1994 | Kildea | |
| 5,525,038 | A | 6/1996 | Sharma et al. | |
| 6,682,301 | B2 * | 1/2004 | Kuhne | F01D 1/04 415/181 |
| 6,709,239 | B2 * | 3/2004 | Chandraker | F01D 5/141 416/238 |
| 6,899,526 | B2 | 5/2005 | Doloresco et al. | |
| 7,047,167 | B2 * | 5/2006 | Yamaguchi | G06F 30/00 703/2 |
| 7,118,329 | B2 | 10/2006 | Goodman et al. | |
| 7,217,101 | B2 * | 5/2007 | Harvey | F01D 5/141 416/223 A |
| 9,017,036 | B2 * | 4/2015 | Straccia | F01D 5/20 416/242 |
| 9,869,191 | B2 * | 1/2018 | Gallagher | F01D 25/24 |
| 10,677,066 | B2 * | 6/2020 | Lewis | F01D 5/141 |
| 10,801,325 | B2 * | 10/2020 | Mongillo | F01D 5/18 |
| 2003/0086788 | A1 * | 5/2003 | Chandraker | F01D 5/141 416/235 |
| 2008/0063531 | A1 | 3/2008 | Sreekanth et al. | |

(Continued)

FOREIGN PATENT DOCUMENTS

| | | |
|---|---|---|
| EP | 1524405 B1 | 1/2014 |
| EP | 2333242 B1 | 6/2015 |

*Primary Examiner* — Courtney D Heinle
*Assistant Examiner* — Jason Fountain
(74) *Attorney, Agent, or Firm* — Armstrong Teasdale LLP

(57) ABSTRACT

A turbine blade for a rotary machine includes an airfoil that extends from a root to a tip along a radial span. The airfoil further includes a first sidewall and a second sidewall that are coupled together at a leading edge of the airfoil and that extend aftward to a trailing edge of the airfoil. One of the first sidewall or the second sidewall includes a tip region having an increased stagger angle that produces a non-linear, over-hanging trailing edge.

14 Claims, 5 Drawing Sheets

(56) References Cited

U.S. PATENT DOCUMENTS

| | | | | |
|---|---|---|---|---|
| 2013/0224040 | A1* | 8/2013 | Straccia | F01D 5/141<br>416/242 |
| 2017/0145828 | A1* | 5/2017 | Lewis | F01D 5/06 |
| 2018/0274368 | A1* | 9/2018 | Mongillo | F01D 5/187 |

* cited by examiner

TURBINE AIRFOIL PROFILE

BACKGROUND

The invention relates generally to an airfoil for a gas turbine engine and, more particularly, to an airfoil profile suited for a high pressure turbine (HPT) stage blade.

At least some known rotary machines include a compressor, a combustor coupled downstream from the compressor, a turbine coupled downstream from the combustor, and a rotor shaft rotatably coupled between the compressor and the turbine. Some known compressors include at least one rotor disk coupled to the rotor shaft, and a plurality of circumferentially-spaced rotary components (e.g. compressor blades and/or axial spacers) that extend outward from each rotor disk to define a stage of the compressor. At least some known rotary components include a platform, a shank that extends radially inward from the platform, and a dovetail region that extends radially inward from the shank to facilitate coupling the rotary component to the rotor disk.

Where a blade airfoil is part of a turbine assembly driving a compressor, and the high pressure turbine blades are un-shrouded and subjected to elevated temperatures and pressures, the requirements for such a blade airfoil design are generally significantly more stringent than for airfoils used with lower pressure turbines, as the compressor relies solely on the HP turbine to deliver all the required work. Unshrouded blades require a solid balance between aerodynamic and structural optimization. Over and above this, the airfoil is subject to flow regimes which lend themselves easily to flow separation or leakage at the blade tips and/or along the turbine hub. Such flow separation may limit the amount of work transferred to the compressor, and hence the total thrust or power capability of the engine. Moreover, controlling over tip leakage flow and associated tip vortex driven losses are significantly important to un-shrouded blades. As such, within at least some known HP turbines, blade tips are typically loaded (i.e., turned less) to facilitate reducing end wall and tip leakage. As such, loading the blade tips may limit the overall efficiency of the turbine.

BRIEF DESCRIPTION

In one aspect, a turbine blade for a rotary machine is provided. The turbine blade includes an airfoil extending from a root to a tip along a radial span. The airfoil further includes a first sidewall and a second sidewall that are coupled together at a leading edge of the airfoil and that extend aftward to a trailing edge of the airfoil. One of the first sidewall or the second sidewall includes a tip region that is formed with an increased stagger angle as compared to remaining portion of the sidewall.

In another aspect, a rotor assembly including a plurality of blades extending outwardly from a hub is provided. The plurality of blades are circumferentially-spaced about the hub and each includes an airfoil including a suction sidewall and a pressure sidewall. The pressure and suction sidewalls extend radially from a root to a tip. The pressure and suction sidewalls are coupled together along a leading edge of the airfoil and at a trailing edge of the airfoil. The trailing edge is spaced aftward from the leading edge and an aft portion of one of the suction sidewall and the pressure sidewall is formed with a shape that facilitates reducing hub secondary losses during turbine operation.

In a further aspect, a turbine rotor for a high pressure turbine is provided. The turbine rotor includes a plurality of blades extending from a rotor disc having an axis of rotation.

Each of the blades includes an airfoil having a shape defined by a suction sidewall and a pressure sidewall. The pressure sidewall of at least one of the airfoils is formed with a shape that facilitates causing a tip vortex to detach from a surface of the airfoil to facilitate reducing tip losses associated with the turbine rotor.

DETAILED DESCRIPTION

The embodiments described herein overcome at least some of the disadvantages of known rotary components. The embodiments include a turbine blade tip section with increased turning, i.e., decreased loading, to facilitate increasing turbine efficiency. More specifically, in each embodiment, during operation, the turbine blade tip section described herein causes the tip vortex to detach from a surface of the blade to facilitate reducing tip losses. Moreover, the turbine blades described herein also facilitates reducing hub losses during turbine operation.

Unless otherwise indicated, approximating language, such as "generally," "substantially," and "about," as used herein indicates that the term so modified may apply to only an approximate degree, as would be recognized by one of ordinary skill in the art, rather than to an absolute or perfect degree. Accordingly, a value modified by a term or terms such as "about," "approximately," and "substantially" is not to be limited to the precise value specified. In at least some instances, the approximating language may correspond to the precision of an instrument for measuring the value. Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item. As used herein, the term "upstream" refers to a forward or inlet end of a rotary machine, and the term "downstream" refers to a downstream or exhaust end of the rotary machine.

Figure 1:
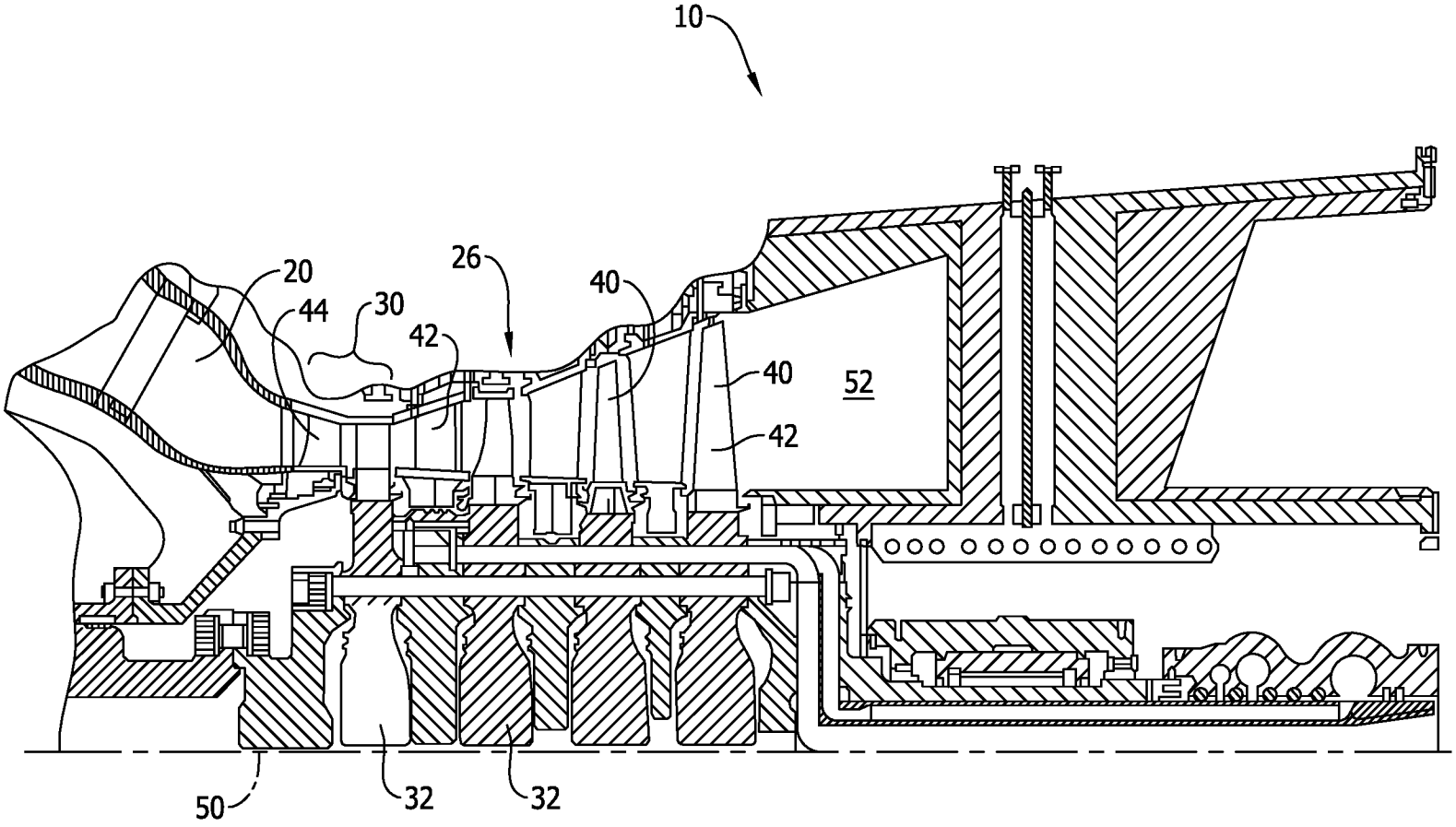
FIG. 1 is a schematic view of a portion of an exemplary gas turbine engine.

FIG. 1 is a schematic view of a portion of an exemplary gas turbine engine 10. Generally engine 10 includes a compressor (not shown) that compresses incoming air and delivers compressed air downstream to a combustor 20. Combustor 20 mixes the compressed flow of air with a pressurized flow of fuel to create a flow of combustion gases. The resulting combustion gases flow downstream to a turbine 26. The flow of combustion gases drive turbine 26 to produce mechanical work. The mechanical work produced in turbine 26 drives the compressor via a shaft and an external load (not shown), such as an electrical generator.

In the exemplary embodiment, turbine 26 is a high pressure turbine that includes a plurality of stages 30. Each stage 30 includes a rotor wheel 32 to which circumferentially-spaced turbine blades 40 are coupled. More particularly, a first stage 30 includes a first stage rotor wheel 32 on which blades 40 having airfoils 42 are mounted in opposition to first stage stator vanes 44. It will be appreciated that a plurality of airfoils 42 are spaced circumferentially one from the other about the first-stage wheel 32. For example, in the exemplary embodiment, there are sixty blades 40 mounted on the first-stage wheel 32.

Blades 40 rotate about an axis of rotation 50 of turbine 26. More specifically, each blade airfoil 42 extends at least partially through an annular hot gaspath 52 defined by annular inner and outer walls 54 and 56, respectively. Walls 54 and 56 direct the stream of combustion gases axially in an annular flow.

Figure 2:
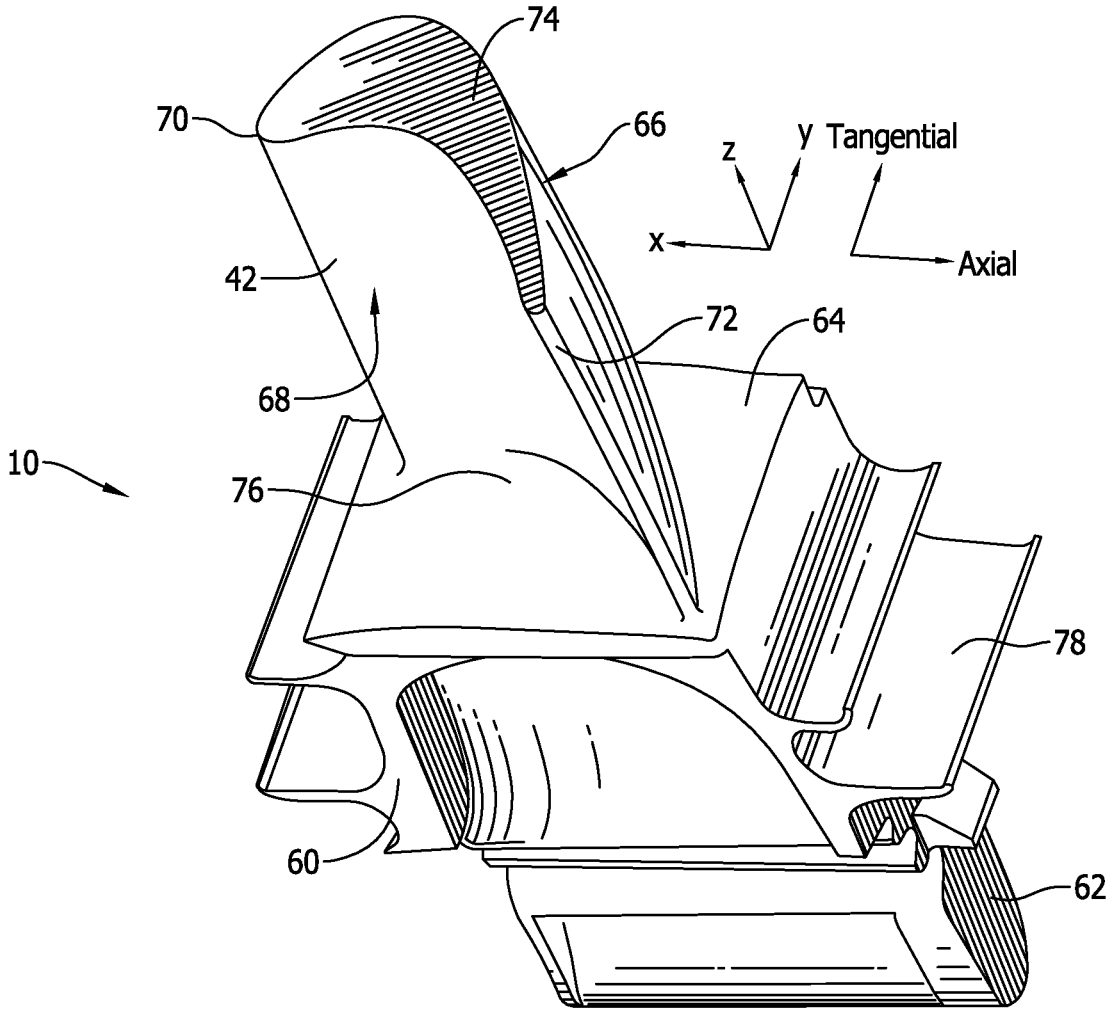
FIG. 2 is a perspective view of a known turbine blade including an airfoil, shank and dovetail that may be used with the gas turbine engine shown in FIG. 1.

FIG. 2 is a perspective view of a known exemplary turbine blade 40 including an airfoil 42, a shank 60, and a dovetail 62 that may be used with gas turbine engine 10. In the exemplary embodiment, turbine blade 40 is used in a high pressure turbine, such as turbine 26. Airfoil 42 is mounted on a platform 64 carried by shank 60. Dovetail 62 extends from a radially inner end of shank 60 for coupling blade 40 to a turbine wheel 32 (shown in FIG. 1). Airfoil 42, platform 64 and dovetail 62 are collectively referred to as a blade, generally designated 40. In the exemplary embodiment, airfoil 42 has a compound curvature with suction and pressure sides 66 and 68, respectively. Airfoil 42 also has a leading edge 70, a trailing edge 72 and a tip 74, and extends radially outward from a root 76 adjacent platform 67 to tip 74.

As is known in the art, it will be appreciated that dovetail 62 mates in openings or slots, i.e., dovetail openings, (not shown) formed in turbine wheel 32 and that a plurality of blades 40 are circumferentially-spaced about wheel 32. More specifically, dovetail 62 is adapted to be received in complementary-shaped dovetail openings defined in wheel 32 such that blade 40 resists axial and centrifugal dislodgement during turbine operation. Additionally, in the exemplary embodiment, there are wheel-space seals 78, i.e., angel wings, formed on the axially forward and aft sides of shank 60.

A Cartesian coordinate system which has mutually orthogonal X-, Y-, and Z-axes is also provided on FIG. 2. The X-axis extends axially along the turbine rotor centerline 50 i.e., the axis of rotation. The positive X direction is axially towards the aft of turbine engine 10. The Z-axis extends along the HPT blade stacking line of each respective blade 40 in a generally radial direction and intersects the X-axis at the center of rotation of turbine engine 10. The positive Z direction is radially outwardly towards blade tip 88. The Y-axis extends tangentially with the positive Y direction being in the direction of rotation of turbine 10.

In addition, portions of each airfoil described herein may be defined by reference to axial and tangential directions. Reference axes are also provided on FIG. 2. The axial direction is defined as extending substantially parallel to a direction of flow through blades 40. The tangential direction is defined as being substantially parallel to a direction of rotation of blades 40.

Figure 4:
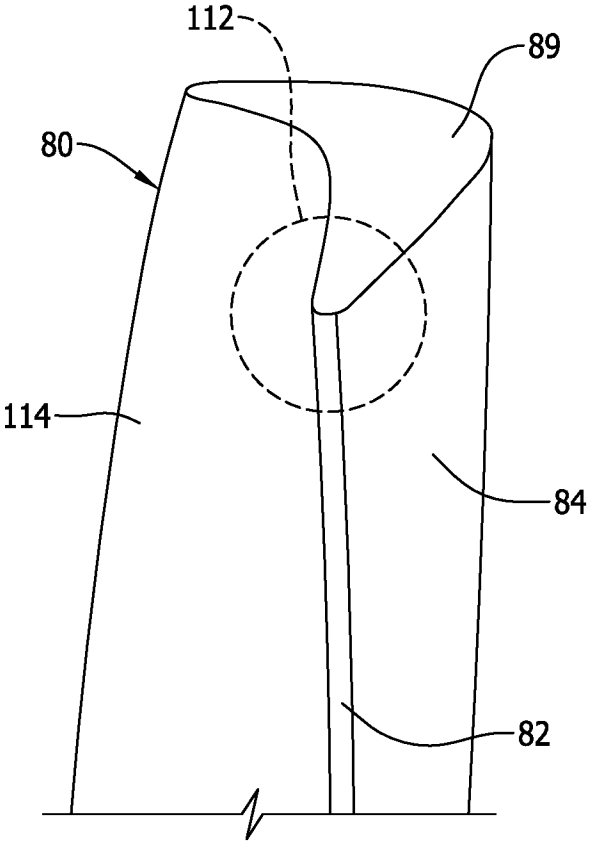
FIG. 4 is a perspective view of the airfoil shown in FIG. 3 and taken along the trailing edge of the tip region of the airfoil.
Figure 3:
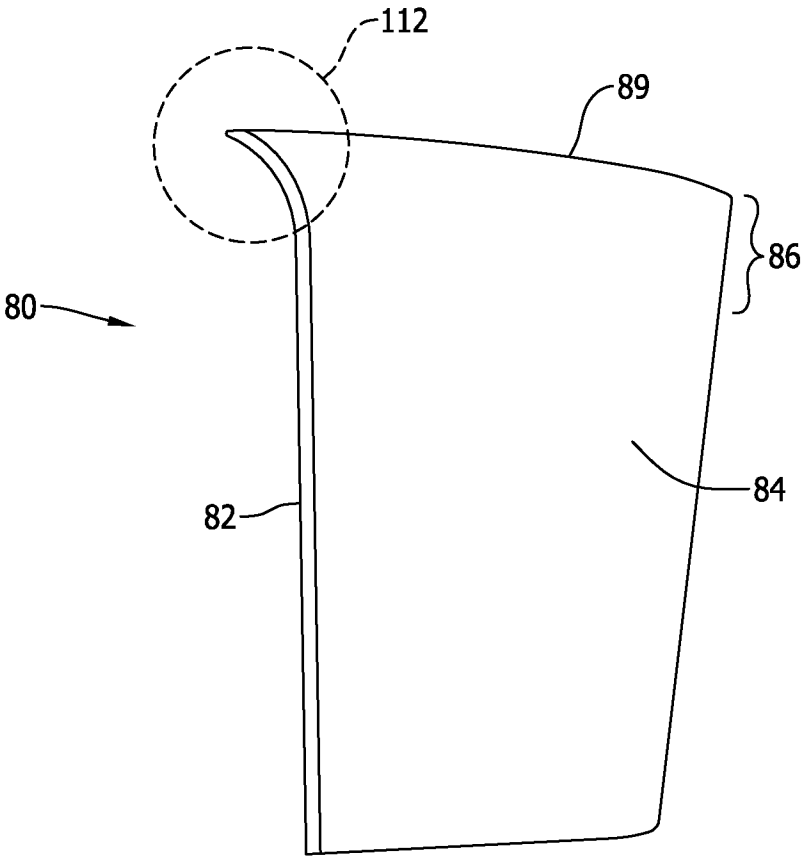
FIG. 3 is a perspective view of a portion of an airfoil that may be used with the turbine blade shown in FIG. 2, as viewed from a trailing edge of the suction side of the tip region of the airfoil.
Figure 6:
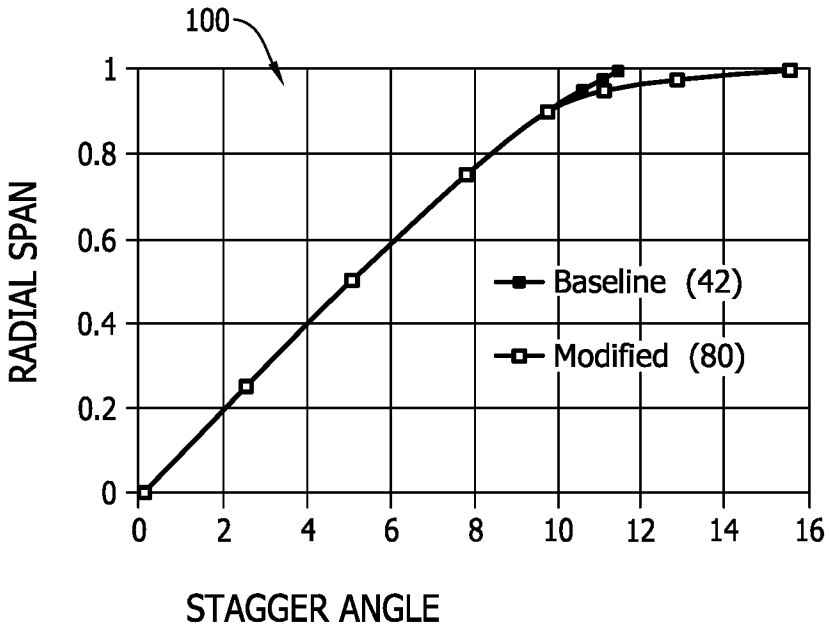
FIG. 6 is an exemplary graph comparing stagger angle versus radial span for the airfoil shown in FIG. 2 versus the airfoil shown in FIG. 3 or 4.
Figure 5:
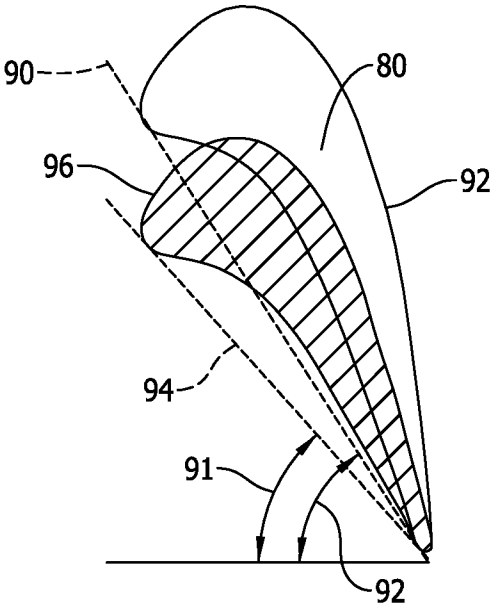
FIG. 5 illustrates a chord-line of a first airfoil cross-sectional view of the airfoil shown in FIGS. 3 and 4, overlaying a chord-line of a second airfoil cross-sectional view of the airfoil shown in FIG. 2.

FIG. 3 is a first perspective view of a portion of an airfoil 80 that may be used with turbine blade 40 (shown in FIG. 1), and viewed from a trailing edge 82 of a suction side 84 of a tip region 86 of airfoil 80. FIG. 4 is a second perspective view of airfoil 80 and taken along trailing edge 82. FIG. 5 illustrates a chord-line 90 of a first airfoil cross-sectional view 92 of airfoil 80 overlaying a chord-line 94 of a second airfoil cross-sectional view 96 of airfoil 42. FIG. 6 is an exemplary graph 100 comparing stagger angle q versus radial span for airfoil 42 versus airfoil 80. As used herein, stagger angle is defined as the angle between a chord line and axial. More specifically, and with respect to FIG. 5, first cross-sectional view 92 is taken in a tip region 86 of airfoil 80 and second cross-sectional view 96 is taken at the same percent of radial span of airfoil 42.

In each embodiment, and as best seen in FIGS. 3 and 4, a profile of airfoil 80 differs from known airfoils, such as airfoil 42, primarily at its tip region 86. In the exemplary embodiment, tip region 86 is defined as being from about 80% of radial span of airfoil 80 to a tip 89 of airfoil 80. More specifically, an aft region 112 of airfoil 42 in the tip region 86 has increased turning towards a pressure side 114 of airfoil blade 80 as compared to the remainder of airfoil 80. Moreover, airfoil 80 also has increased tip turning as compared to known turbine blades, such as blades 40 (shown in FIG. 1) used with HPT turbines, such as turbine 26 (shown in FIG. 1). In fact, airfoil 80 has an over-cambered/turned tip region 86 that has increased turning as compared to those areas associated with airfoils used with known turbine blades. In addition, and as best seen in FIG. 4, the increased turning within tip region 86, and more specifically, aft region 112, increases a length of a backbone airfoil 80.

Increasing the tip turning within aft region 112 rapidly increases the stagger angle q for airfoil 80 within tip region 86. As used herein, stagger angle q is defined as an angle measured between the chord line, such as chord lines 90 or 94, and the turbine axial flow direction. As shown in FIG. 5, the stagger angle $q_2$ defined within tip region 86 of airfoil 80 is substantially greater than the stagger angle $q_1$ defined at the same percent of radial span of airfoil 42. As a result of the increased stagger angle $q_2$, a portion of trailing edge 82 within aft region 112 overhangs on airfoil pressure side 114.

In addition, and as best seen in FIG. 6, the profile of the baseline airfoil, such as airfoil 42, is substantially identical to the profile of airfoil 80 other than the profile defined within tip region 86. Tip region 86 is formed with increased stagger angle that produces a non-linear, over-hanging trailing edge. More specifically, in the exemplary embodiment, increased turning of tip region 86 begins at about 85% of radial span. In fact, as shown in FIG. 6, at about 85% a sharp change in the stagger angle distribution within airfoil 80 occurs relative to the baseline profile 42. In other embodiments, tip region 86 increased turning begins at more or less than 85% of radial span. For example, in one embodiment, increased turning within tip region 86 begins at about 75% of radial span. Increased tip turning of tip region 86 can begin at any radial span percentage that facilitates airfoil 80 performing as described herein.

Figure 7:
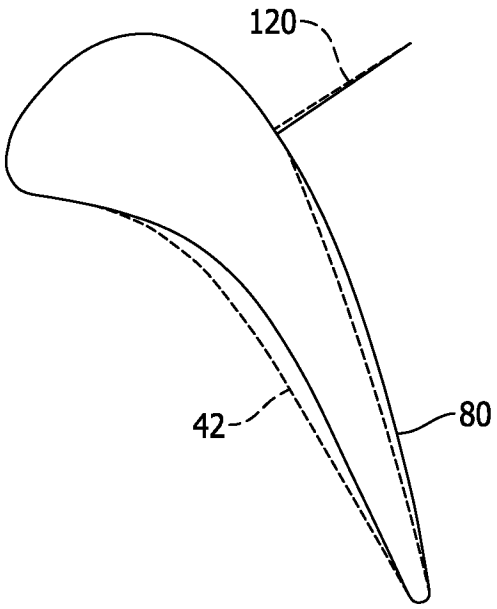
FIG. 7 illustrates an exemplary trailing edge over-turning of a cross-sectional view of the airfoil shown in FIGS. 3 and 4 overlaying a cross-sectional view of the airfoil shown in FIG. 2.

FIG. 7 illustrates an exemplary trailing edge over-turning of a cross-sectional view of airfoil 80 overlaying a cross-sectional view of airfoil 42. As used herein, trailing edge over-turning is defined as being equal to the gas angle for the airfoil minus the trailing edge metal angle. Metal angle is known in the art and is defined as the angle between a camber line of the airfoil and an axial line at the trailing edge 72 of airfoil 80. Moreover, gas angle is known in the art and is defined as the angle defined between the airfoil camber line and an outlet flow direction at airfoil trailing edge 72. Flow exit angle does not equal exit metal angle. With this formula, a negative over-turning means that the metal angle is more tangential than the gas angle and that the metal angle turns more than the gas angle. In contrast, a positive over-turning means that the gas angle is turned more than the metal angle. Accordingly, in FIG. 7, airfoil 80 has greater negative over-turning than airfoil 42. Moreover, airfoil 80 has an increased suction side curvature than airfoil 42. More specifically, airfoil 80 has an increased suction side curvature extending from a throat line 120 to the trailing edge, as compared to airfoil 42. Alternatively, airfoil 80 may have more or less overturning than is illustrated in FIG. 7, and/or increased suction side curvature. In other embodiments, airfoil 80 may have any other cross-sectional shape that facilitates reducing tip leakage losses, increasing turbine efficiency, and/or decreasing loading on the airfoil as described herein.

The rapid increase in trailing edge metal angle, i.e., increased turning in the tangential direction, of airfoil 80 in tip region 86 facilitates increasing the local stream wise curvature near the trailing edge 72 of airfoil 80. The combination of the increased turning of tip region 86 and the increased backbone length of airfoil 80 facilitates causing the tip vortex to detach from the blade surface during turbine operation. As a result, tip leakage losses with airfoil 80 are facilitated to be reduced as compared to known HPT turbine blades, such as blades 40. In some embodiments, using an altered blade stacking in combination with airfoil 80, also facilitates reducing hub secondary losses. In addition, as tip leakage losses are decreased, turbine efficiency is facilitated to be increased. More specifically, the increased turning decreases loading on the airfoil and thus facilitates increasing turbine efficiency.

The above description is meant to be exemplary only, and one skilled in the art will recognize that changes may be made to the embodiments described without department from the scope of the invention disclosed. For example, the airfoil may be scaled geometrically, while maintaining the same proportional relationship and airfoil shape, for application to gas turbine engines of other sizes. Still other modifications which fall within the scope of the present invention will be apparent to those skilled in the art, in light of a review of this disclosure, and such modifications are intended to fall within the appended claims. Moreover, the airfoil may include more or less increased turning than those described herein.

Exemplary embodiments of a rotary component apparatus for use in a gas turbine engine are described above in detail. The apparatus are not limited to the specific embodiments described herein, but rather, components of systems may be utilized independently and separately from other components described herein. For example, the airfoil profile may also be used in combination with other rotary machines and methods, and are not limited to practice with only the gas turbine as described herein. Rather, the exemplary embodiment can be implemented and utilized in connection with many other rotary machine applications.

Although specific features of various embodiments of the invention may be shown in some drawings and not in others, this is for convenience only. Moreover, references to "one embodiment" in the above description are not intended to be interpreted as excluding the existence of additional embodiments that also incorporate the recited features. In accordance with the principles of the invention, any feature of a drawing may be referenced and/or claimed in combination with any feature of any other drawing.

While the invention has been described in terms of various specific embodiments, those skilled in the art will recognize that the invention can be practiced with modification within the spirit and scope of the claims.

What is claimed is:

1. A turbine blade for a rotary machine, said turbine blade comprising an airfoil extending from a root to a tip along a radial span, said airfoil further comprising a first sidewall and a second sidewall, said first and second sidewalls coupled together at a leading edge of said airfoil and extending aftward to a trailing edge of said airfoil, one of said first sidewall and said second sidewall comprises a linear region and a tip region, wherein said first sidewall defines a pressure side of said airfoil, said linear region having a first stagger angle that increases at a substantially constant rate throughout, and said tip region formed with a second stagger angle that is increased as compared to said first stagger angle of said linear region of said sidewall, such that said tip region facilitates reducing tip vortex losses of said airfoil, and such that said tip region forms an overhang along said pressure sidewall.

2. The turbine blade according to claim 1 wherein said tip region with said second stagger angle is formed along said first sidewall.

3. The turbine blade according to claim 1 wherein said linear region extends from said root to about 85% of the radial span of said airfoil, and wherein said tip region formed with said second stagger angle extends from about 85% of the radial span of said airfoil to said tip of said airfoil.

4. The turbine blade according to claim 1 wherein said linear region extends from said root to at least 75% of the radial span of said airfoil, and wherein said tip region formed with said second stagger angle extends from about greater than 75% of the radial span of said airfoil to said tip of said airfoil.

5. The turbine blade according to claim 1 wherein within said trailing edge over-turning, a metal angle of said airfoil trailing edge is more tangential than a gas angle of said airfoil.

6. A rotor assembly comprising a plurality of blades extending outwardly from a hub, said plurality of blades circumferentially-spaced about said hub and each comprises an airfoil comprising a suction sidewall and a pressure sidewall, said pressure and suction sidewalls extending radially from a root to a tip along a radial span, said pressure and suction sidewalls coupled together along a leading edge of said airfoil and at a trailing edge of said airfoil, said trailing edge spaced aftward from said leading edge, a linear region of one of said suction sidewall and said pressure sidewall is formed with a first stagger angle that increases at a substantially constant rate throughout, and an aft portion of the one of said suction sidewall and said pressure sidewall is formed with a second stagger angle that is increased as compared to said linear region of said airfoil, such that said aft portion facilitates reducing tip vortex losses of said airfoil, wherein said second stagger angle is formed in a tip region of said airfoil adjacent to said tip such that said region forms an overhang along said pressure sidewall.

7. The rotor assembly in accordance with claim 6 wherein said linear region extends from said root to about 85% of the radial span of said airfoil, and wherein said tip region second stagger angle is formed from about 85% of the radial span of said airfoil to said tip.

8. The rotor assembly in accordance with claim 6 wherein said linear region extends from said root to at least 75% of the radial span of said airfoil, and wherein said tip region second stagger angle is formed from about greater than 75% of the radial span of said airfoil to said tip.

9. The rotor assembly in accordance with claim 6 wherein said airfoil is further formed with trailing edge over-turning wherein a metal angle of said airfoil trailing edge is more tangential than a gas angle of said airfoil.

10. The rotor assembly in accordance with claim 6 wherein said plurality of blades form a single stage of said rotor assembly.

11. A turbine rotor for a high pressure turbine, said turbine rotor comprising a plurality of blades extending from a rotor disc having an axis of rotation, each said blade comprising an airfoil having a shape defined by a suction sidewall and a pressure sidewall, said pressure sidewall of at least one of said airfoils is formed with a linear region that has a first stagger angle that increases substantially constant throughout, and a tip region formed with a shape that facilitates causing a tip vortex to detach from a surface of said at least one airfoil to facilitate reducing tip losses associated with said turbine rotor, said at least one airfoil pressure sidewall is formed with a second stagger angle within said tip region, such that said region forms an overhang along said pressure sidewall.

12. The turbine rotor in accordance with claim 11 wherein said at least one airfoil comprises a root, a tip, and a radial span therebetween, wherein said linear region extends from said root to about 85% of the radial span of said airfoil, wherein said second stagger angle is defined between 85% of the radial span of said airfoil to said tip, said second stagger angle is increased as compared to said first stagger angle to facilitate improving turbine rotor efficiency.

13. The turbine rotor in accordance with claim 11 wherein said at least one airfoil comprises a root, a tip, and a radial span therebetween, wherein said linear region extends from said root to about 75% of the radial span of said airfoil, wherein said second stagger angle is defined between 75% of the radial span of said airfoil to said tip, said second stagger angle is increased as compared to said first stagger angle to facilitate improving turbine rotor efficiency.

14. The turbine rotor in accordance with claim 11 wherein within said trailing edge over-turning wherein a metal angle of said airfoil trailing edge is more tangential than a gas angle of said airfoil.

* * * * *